US006659364B1

(12) United States Patent
Humberstone et al.

(10) Patent No.: US 6,659,364 B1
(45) Date of Patent: Dec. 9, 2003

(54) DROPLET GENERATION METHOD AND DEVICE

(75) Inventors: Victor Carey Humberstone, Cambridge (GB); David Mark Blakey, Cambridge (GB)

(73) Assignee: The Technology Partnership, PLC, Herts (GB)

( * ) Notice: Subject to any disclaimer, the term of this patent is extended or adjusted under 35 U.S.C. 154(b) by 0 days.

(21) Appl. No.: 09/913,406

(22) PCT Filed: Feb. 11, 2000

(86) PCT No.: PCT/GB00/00443

§ 371 (c)(1),
(2), (4) Date: Aug. 14, 2001

(87) PCT Pub. No.: WO00/47334

PCT Pub. Date: Aug. 17, 2000

(30) Foreign Application Priority Data

Feb. 15, 1999 (GB) ..... 9903433

(51) Int. Cl.[7] ..... B05B 17/04; B05B 1/08
(52) U.S. Cl. ..... 239/4; 239/102.1; 239/102.2
(58) Field of Search ..... 239/4, 102.2, 102.1, 239/558, 589.1, 590.3, 145, DIG. 12, 101; 310/324, 331, 332, 321, 328

(56) References Cited

U.S. PATENT DOCUMENTS 4,018,383 A * 4/1977 Paton et al. ..... 239/4
5,153,612 A * 10/1992 Dunn et al. ..... 347/87
5,261,601 A * 11/1993 Ross et al. ..... 239/102.2
5,299,739 A * 4/1994 Takahashi et al. ..... 239/102.2
5,409,163 A * 4/1995 Erickson et al. ..... 239/4
5,823,428 A * 10/1998 Humberstone et al. ..... 239/4

FOREIGN PATENT DOCUMENTS

| | | |
|---|---|---|
| EP | 0 493 102 | 7/1992 |
| JP | 11010865 | 1/1999 |
| WO | WO 95/15822 | 6/1995 |

* cited by examiner

*Primary Examiner*—Davis Hwu
(74) *Attorney, Agent, or Firm*—Dykema Gossett PLLC

(57) ABSTRACT

A method of and apparatus for generating liquid droplets from an aperture in a membrane are disclosed in which the aperture has a diameter $\phi$ at one face which is at most as large as its diameter at the other face, and a liquid is provided to the one face of the membrane adjacent the aperture. The liquid has a surface tension $\sigma$ and density $\rho$. A pressure bias is applied such that the pressure of the liquid at the one face of the membrane is lower than the pressure immediately adjacent to the opposing face of the membrane, and while the bias pressure is applied, the membrane is vibrated at a frequency f which is determined by the relationship:

$$f \leq \left(\frac{5\pi\sigma}{\rho\phi^3}\right)^{1/2}$$

in order to generate droplets emerging from the other face.

13 Claims, 4 Drawing Sheets

DROPLET GENERATION METHOD AND DEVICE

The present invention relates to droplet generation and, more particularly, to the generation of liquid droplets from a membrane having one or more apertures.

In our European Patent EP-B-0615470, we describe an apparatus of this general type and there are numerous other examples of droplet generators of this type, see in particular, our European Patent EP-B-0732975.

Other prior art of possible relevance includes: EP-A-0 432 992, GB-A-2 263 076, EP-A-0 516 565, U.S. Pat. No. 3,738,574, EP-A-0 480 615, U.S. Pat. No. 4,533,082 & U.S. Pat. No. 4,605,167.

In our EP-B-0732975 we describe and claim a liquid droplet spray device comprising a perforate membrane; an actuator, for vibrating the membrane; and means for supplying liquid to a surface of the membrane, characterised in that perforations in the membrane have a larger cross-sectional area at that face of the membrane away from which liquid droplets emerge than at the opposite face of the membrane.

According to EP-B-0732975, such a device is a perforate membrane capillary wave droplet generator believed to be excited and to pin capillary waves within the small orifice of the membrane perforations. It employs a perforate membrane designed to spatially match the excited capillary wave field (i.e. one or more capillary waves pinned within each orifice), so that the coupling efficiency of energy transferred to the oscillating capillary waves is greatly enhanced over free-surface capillary wave generators. Thus, significantly lower power and lower cost devices can be employed to generate droplets using the capillary wave approach. However, even with the enhanced energy coupling provided in such devices, devices of this type together with the drive electronics needed to excite their operation still consume up to 10 W of power to operate in the 250 kHz–8 MHz frequency region to enable the production of small water droplets between 1 and 10 $\mu$m in diameter. It is desirable to create such small droplets, for example, in order to practice electrophotography as described in our International patent application no. PCT/GB96/01671.

The present invention is aimed particularly, but not solely, at reducing the power consumption necessary to produce small droplets using a device of the vibratory perforate membrane type. Drive electronics operating at higher frequencies in the range 250 kHz to 8 MHz are also generally more expensive than drive electronics otherwise similar in nature but operating at lower frequencies. The present invention, in allowing lower frequency operation of vibrating perforate membrane droplet generators, therefore also has utility in reducing the overall cost of such droplet generators, particularly in the production of small droplets relative to those of capillary wave type described above.

According to the present invention, there is provided a method of generating liquid droplets from an aperture in a membrane, the aperture having a diameter $\phi$ at one face at most as large as its diameter at the other face, the method comprising providing a liquid to the one face of the membrane adjacent the aperture, the liquid having a surface tension $\sigma$ and density $\rho$;

applying a pressure bias such that the pressure of the liquid at the one face of the membrane is lower than the pressure immediately adjacent to the opposing face of the membrane; and while the bias pressure is applied, vibrating the membrane at a frequency f which is determined by the relationship:

$$f \leq \left(\frac{5\pi\sigma}{\rho\phi^3}\right)^{1/2}$$

in order to generate droplets emergent from the other face.

The invention also includes a droplet generator for generating droplets of a liquid having a surface tension $\sigma$ and density $\rho$, the droplet generator comprising a membrane having a first face and a second face, an aperture extending through the membrane from the first face to the second face, the aperture being of a diameter $\phi$ at the first face at most as large as its diameter at the second face;

means for applying a pressure bias such that the pressure of the liquid at the first face of the membrane is lower than the pressure immediately adjacent to the second face of the membrane; and a vibration generating means for causing the membrane to vibrate at a frequency f which is determined by the relationship:

$$f \leq \left(\frac{5\pi\sigma}{\rho\phi^3}\right)^{1/2}$$

in order to generate droplets emergent from the other face.

The invention further includes a liquid atomisation head for a droplet generator for generating droplets of a liquid having a surface tension $\sigma$ and density $\rho$, the liquid atomisation head comprising a membrane having a first face and a second face, an aperture extending through the membrane from the first face to the second face, the aperture being of a diameter $\phi$ at the first face at most as large as its diameter at the second face; and a vibration generating means for causing the membrane to vibrate at a frequency f which is determined by the relationship:

$$f \leq \left(\frac{5\pi\sigma}{\rho\phi^3}\right)^{1/2}$$

in order to generate droplets emergent from the other face.

By "liquid atomisation head" is meant a device which, in use, converts liquid in contact with it into liquid droplets emergent from it. This includes aerosol generation and ink jet devices. "Liquid" is to be understood to include pure liquids, mixtures of liquids, solutions, and suspensions of solid particles within a liquid carrier.

According to a second aspect of the invention, the relationship in the statements of invention defined above is replaced by the relationship:

$$f \leq \left(\frac{3.6\times10^{-4}\cdot\pi}{\phi^3}\right)^{1/2}$$

The relationship immediately above applies in the case, particularly, but not exclusively, of water, and falls wholly within the definition of the frequency relationship given previously above.

Preferably, the vibration generating means is integrally or intimately formed with the membrane.

Prior art devices of the vibrating perforate membrane type are most commonly known with perforations that decrease in size from the side of the membrane to which bulk liquid is supplied to the opposite, droplet-emergent, side. These are known as forward-tapered perforations and in devices having such forward-tapered perforations, droplet ejection consistent with the condition $f \leqq (5\Pi\sigma/\rho\phi^3)^{1/2}$ is understood from, for example U.S. Pat. No. 5,164,740. However, droplet ejection under that condition with devices in which the perforations are tapered as in devices according to the present invention, ('reverse-tapered'), has not been previously observed. Furthermore, droplet generation in these circumstances cannot be understood from the capillary wave mechanism known from previous reverse taper devices as described, for example, in EP-B-0732975.

Ultrasonic droplet generators, which are preferably used in the present invention, typically have a number of harmonic vibration frequencies at which they will resonate. At some of these harmonic frequencies, a capillary wave may be excited within each membrane perforation or aperture. As the harmonic vibration frequency increases, so the capillary wavelength of excited capillary waves decreases and the emergent droplet diameter reduces accordingly. These features are known from the following equations:

$$\phi_d \approx \lambda/3$$

and $$\lambda^3 = \frac{8\pi\sigma}{\rho f^2} \tag{1}$$

where $\phi_d$ is the droplet diameter and $\lambda$ is the wavelength of the capillary wave.

According to the model presented in EP-B-0732975, an apparatus is provided with membrane orifices such that one or more such capillary waves fits within and is "pinned" by the relatively large opening of a perforation at the rear face of a membrane.

In this way, an otherwise large opening at the rear face of a membrane can produce a small droplet emerging from the front face of the membrane. For a given liquid (and hence $\sigma$ and $\rho$) the diameter of the emerging droplet is primarily determined by the meniscus frequency at which the capillary wave is vibrating and the large opening at the rear face of the membrane serves to pin the capillary wave within it rather than determine the droplet diameter.

Conversely, as the harmonic vibration frequency decreases, the capillary wave length increases and the emergent droplet diameter increases. However, droplet generation according to the capillary wave mechanism as described in EP-B-0732975 only occurs at frequencies above that frequency at which a capillary wave length is supported by the opening at the rear face of the membrane. The present inventors have shown that droplet generation can be obtained at lower frequencies and that, in this new low-frequency regime, the droplet production mechanism deviates from the capillary wave model referred to above in equation 1. In droplet generation according to the new mechanism, in this low frequency regime, the droplet size is generally found to be of a diameter approximately equal to that of the opening in the rear face of the membrane, rather than following the frequency-dependency expressed by equation (1).

In droplet generation according to this new mechanism it is found necessary to apply a bias pressure to the liquid contacting the rear face of the membrane. The bias pressure is selected to maintain that liquid at a pressure lower than the pressure (which is typically but not necessarily atmospheric pressure) immediately adjacent the opposing face of the membrane. This bias pressure is selected to be sufficient to overcome the liquid pumping effect described in EP-B-0732975 and is preferably insufficient to draw air through the perforations into the liquid. Thus, a new droplet generating mechanism is employed, the result of which is the ability to create a given droplet diameter at a frequency much below that required by the capillary wave model.

The present invention thereby enables low frequency production of small droplets, i.e. droplets smaller in diameter that those predicted by the capillary wave model, at a given harmonic vibration frequency. This advantage is particularly marked in the production of droplets in the size range of 1 $\mu$m to 10 $\mu$m from such 'reverse taper' devices. This reduction in frequency reduces the electrical power needed for droplet production and the cost of drive electrodes to produce the needed motional excitation of the membrane.

It should be noted that the negative bias pressure provided in operation does not require that the liquid is brought to the membrane at a negative bias pressure, only that the liquid is subjected to a negative bias pressure at those times that droplet generation is required. For example, the liquid may be brought to the perforate membrane at a pressure equal to that immediately in front of the perforate membrane, or even brought to the perforate membrane at a higher pressure that is insufficient, of itself, to cause the liquid to flow through the perforations. Thereafter, when atomisation into droplets is required, means may be employed either to reduce the pressure (of the liquid body that then contacts those perforations) below the pressure immediately in front of the perforate membrane, or to increase the pressure of the atmosphere immediately in front of the membrane, either of which creates the same desired pressure differential. Either simultaneously with establishing that pressure differential or at a subsequent time whilst that pressure bias remains, the vibration of the membrane (in the defined frequency range) can then be excited to produce droplets.

This new droplet mechanism is much more robust in the production of atomised particle suspensions, as well as solutions, without clogging of the apertures or perforations, than prior art 'forward taper' droplet production devices such as those cited above. This applies particularly to its use with small perforations to produce small droplets such as described above. This advantage derives from the reverse taper nature of the perforations or apertures, which together with the bias pressure, described, is believed to pin the fluid meniscus at that face of the membrane to which liquid is supplied leaving the perforation itself unfilled by the liquid or suspension.

One example of a device constructed in accordance with the present invention will now be described with reference to the accompanying drawings in which.

Figure 1:
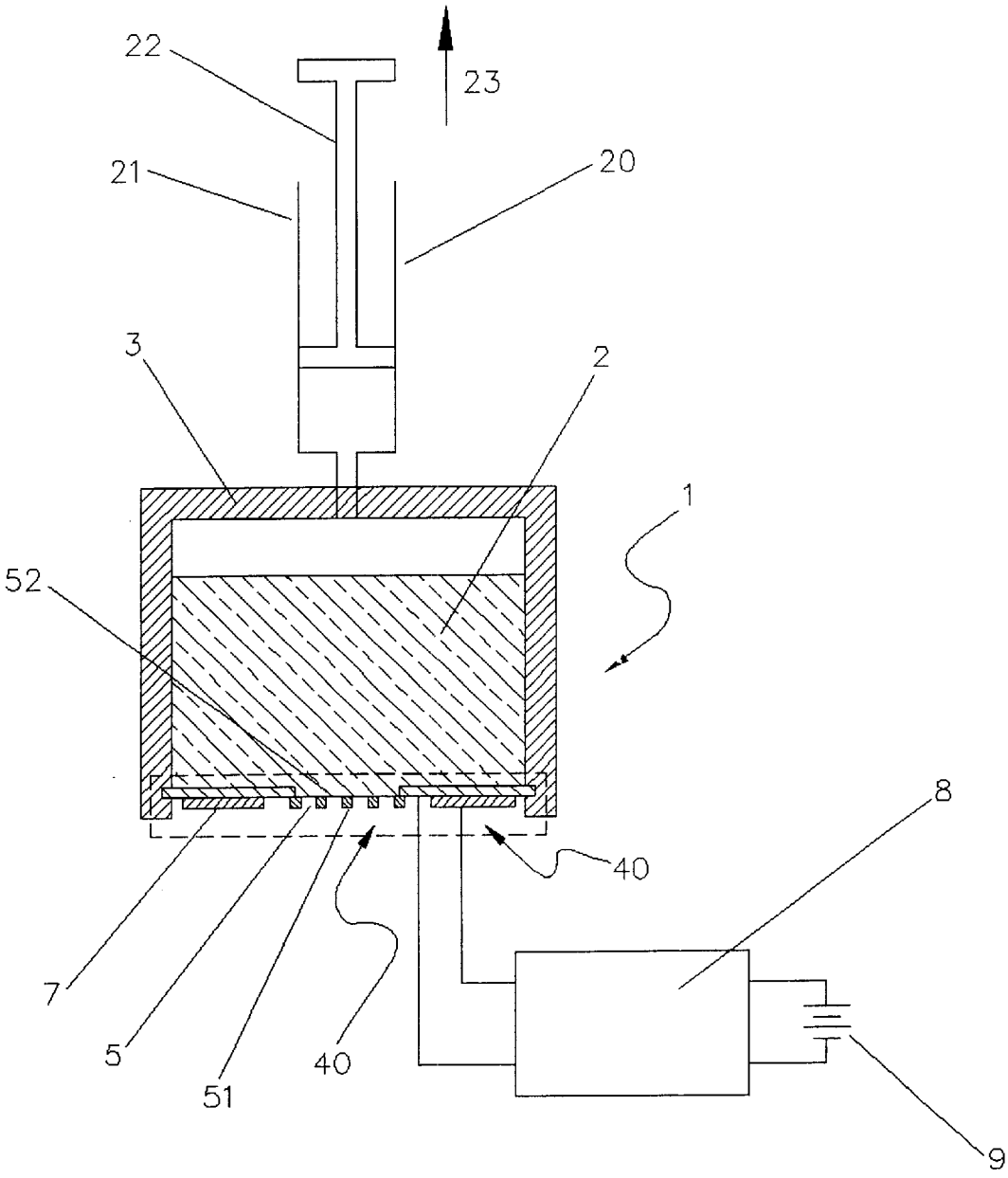
FIG. 1 shows, in section, a schematic of a droplet dispensation apparatus.

FIG. 1 shows a droplet dispensing apparatus 1 comprising an enclosure 3 directly feeding liquid 2 to the rear face 52 of a perforate membrane 5 and a vibration means or actuator 7, shown by way of example as an annular electro-acoustic disc and substrate and which is operable by an electronic circuit 8. Liquid storage and delivery to the rear face 52 are effected, for example, by an enclosure 3 as shown in FIG. 1. Also shown is a syringe 20 comprising a syringe body 21 and a piston 22 that forms a sliding seal with the syringe body. The motion of the piston 22 in the direction shown by arrow 23 allows the pressure of liquid 2 in contact with the rear face 52 of the membrane 5 to be set at a value lower than the atmospheric pressure of air immediately adjacent the front face 51 of that membrane, the pressure differential typically being supported by the menisci of liquid at the membrane perforations 50 (shown more particularly in FIG. 4). The circuit 8 derives electrical power from a power supply 9 to vibrate the perforate membrane 5 substantially perpendicular to the plane of the membrane, so producing droplets of liquid emerging away from the front face 51 of the perforate membrane. The perforate membrane 5 and actuator 7 in combination are hereinafter referred to as an atomisation head 40.

The atomisation head 40 is held captured in a manner that does not unduly restrict its vibratory motion, for example by a grooved annular mounting formed of a soft silicone rubber (not shown).

Figure 2:
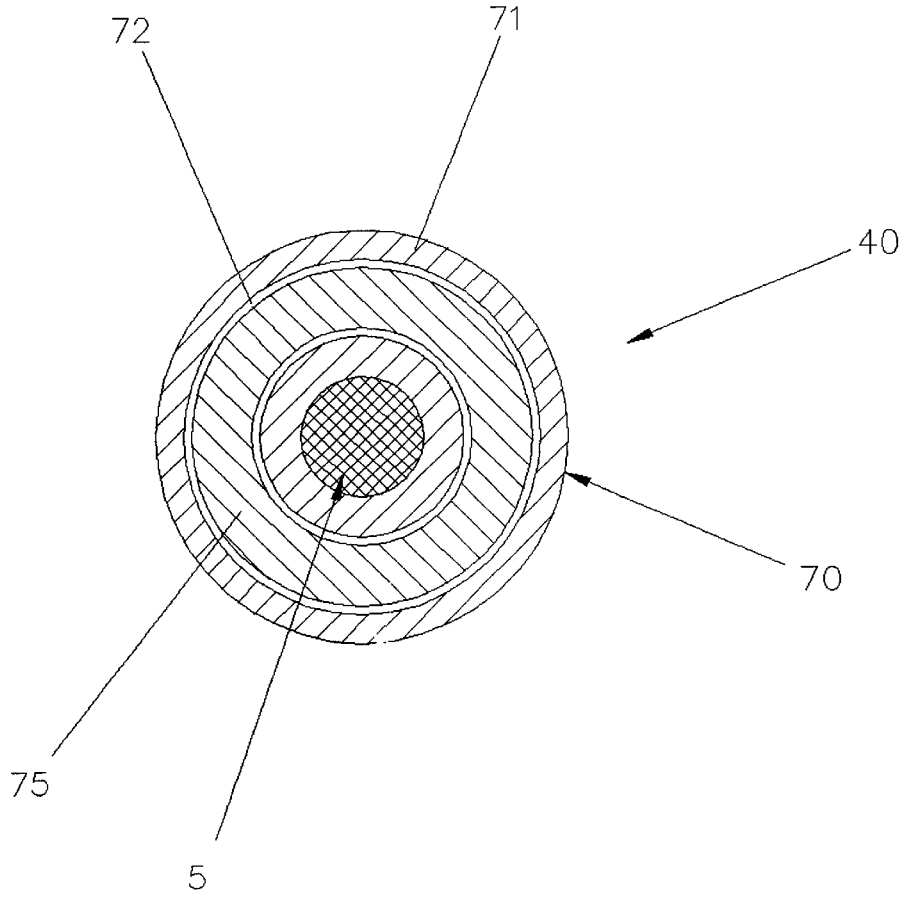
FIGS. 2 and 3 show a plan and a sectional view respectively through the atomisation head.
Figure 3:
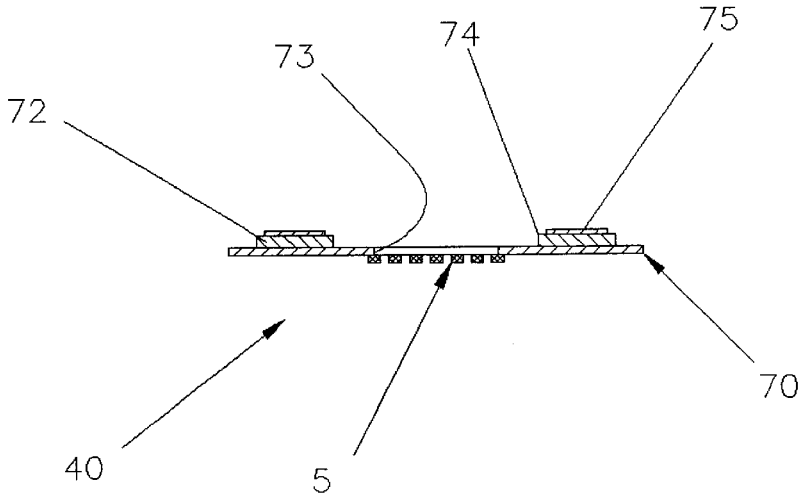

FIGS. 2 and 3 show a plan and a sectional view respectively through one appropriate form of an atomisation head 40. This atomisation head consists of an electro-acoustical disc 70 comprising an annulus 71 of stainless steel to which a piezoelectric ceramic annulus 72 and the circular perforate membrane 5 are bonded. The perforate membrane is as described in more detail with reference to FIG. 4. The stainless steel annulus has outside diameter of 20 mm, thickness of 0.4 mm and contains a central concentric hole 73 of diameter 4.0 mm. The piezoelectric ceramic is of type P51 from CeramTec of Lauf, Germany and has an outside diameter of 14 mm, an internal diameter of 7 mm and a thickness of 0.3 mm. The upper surface 74 of the ceramic has a drive electrode 75 and an optional sense electrode (not shown), which may consist of a 2.0 mm wide metallisation that extends radially substantially from the inner to the outer diameter. The drive electrode 75 extends over the rest of the surface and is electrically insulated from the optional sense electrode by a 0.5 mm air gap. Electrical contacts are made by soldered connections to fine wires (not shown).

In operation, the drive electrode 75 is driven using the electronic circuit 8 by a sinusoidal or square-wave signal at a frequency typically in the range 50 to 300 kHz with a peak to peak amplitude of approximately 60V.

Figure 4:
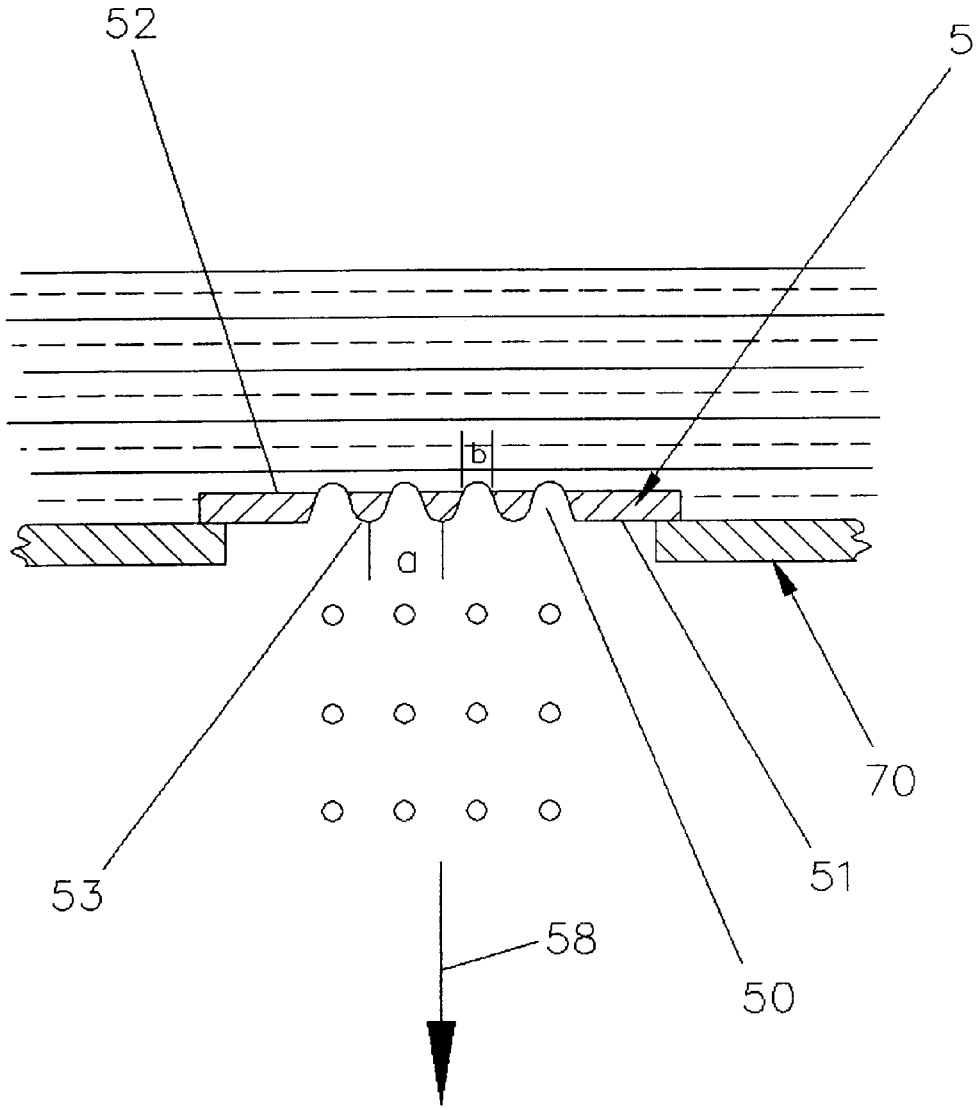
FIG. 4 shows cross-sectional detail of the perforate membrane.

FIG. 4 shows cross-sectional detail of a perforate membrane 5 according to the invention, which membrane is operable to vibrate substantially and suitably for use with droplet dispensing apparatus 1 in the direction of arrow 58. The membrane 5 is shown disposed on the upper (as shown) side of the actuator 7 as opposed to the lower side as illustrated in FIGS. 1 to 3. Either location is possible. The membrane is formed as a circular disc of diameter 6 mm from electroformed nickel. A suitable supplier is Stork Veco of Eerbeek, The Netherlands. The membrane thickness is 70 microns and it is formed with a plurality of perforations shown at 50 which have a continuously increasing taper angle that forms a roughly semi-circularcross-section of material between two adjacent perforations as shown at 53. The smallest diameter of the holes, located at the 'rear' face 52 are of diameter shown at "b" of 15 microns. The perforations are laid out in an equilateral triangular lattice of pitch shown at "a" of 170 $\mu$m.

Droplet generation occurs as follows when using a perforate membrane described generally with reference to FIG. 4, in an atomisation head described with reference to FIGS. 2 and 3 and the system described with reference to FIG. 1. To start, the syringe 20 is used to expand the volume of enclosure 3 (spraying according to the new droplet generation mechanism requiring a pressure differential sufficient to oppose fluid flow out onto the front face 51 of the membrane) and the electronic circuit 8 is used to excite the atomisation head 40 with an alternating voltage of 60V peak to peak amplitude at a frequency of approximately 58 kHz. Spraying of droplets with this particular device occurred at a pressure differential typically within the range −80 to −190 mbar and produced droplets of approximately 15 microns diameter. At −190 mbar pressure differential the perforate membrane acts as bubble generator. Bubble generators, volume-expansion methods such as the syringe described above and expandable bellows constructions, capillary methods such as wicks, tubes and narrow gaps between material layers, and other means for providing a pressure differential opposing flow may all be used with the present invention.

At a frequency of 58 kHz, the corresponding calculated capillary wavelength is approximately 80 $\mu$m, much larger than the minimum opening dimension of the perforations is actually used. This device is the best embodiment of the invention known to the inventors for producing droplets in the region of 15 microns.

Figure 5:
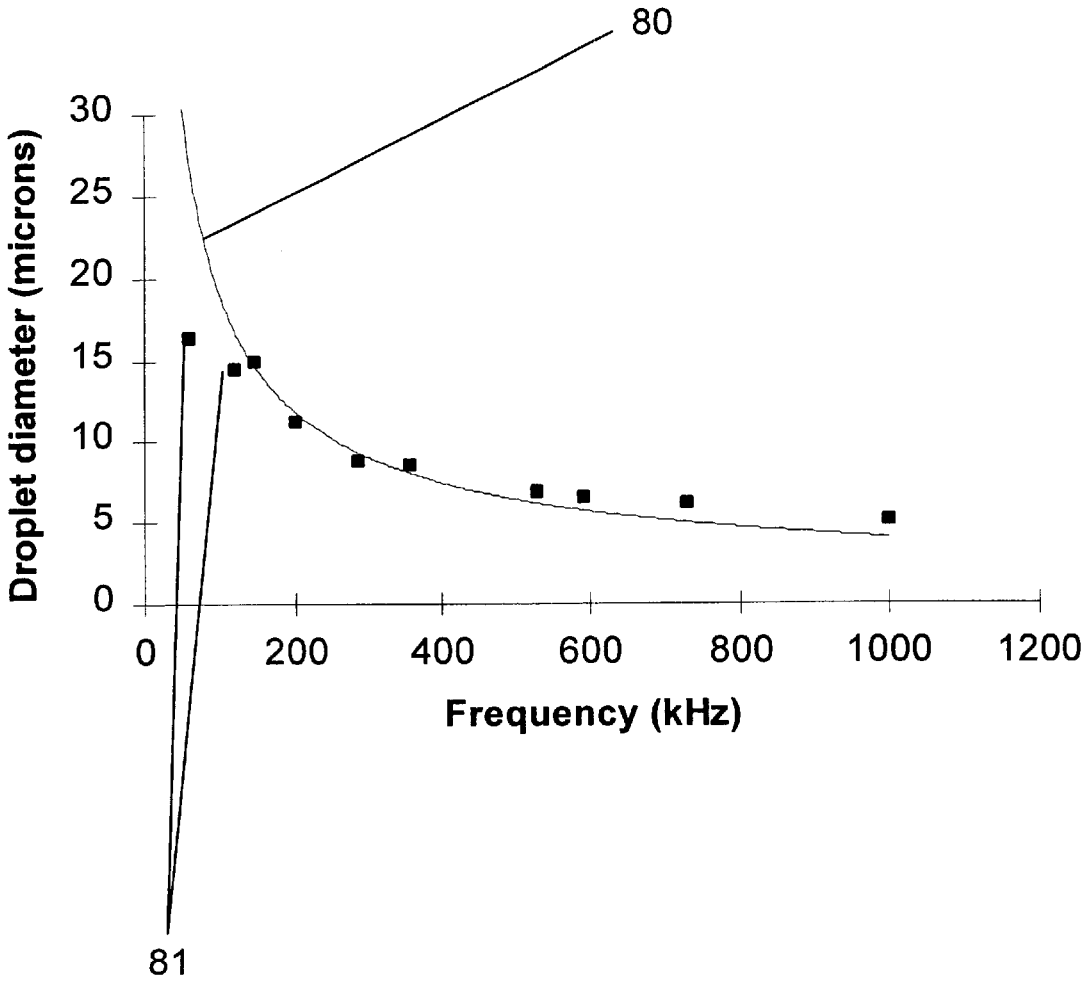
FIG. 5 is a graph showing reverse taper droplet size as a function of vibrational frequency.

FIG. 5 is a graph of droplet diameter plotted against frequency, showing a comparison of droplet size between capillary mode droplet generation (line "80" shown on the graph) and generation according to the invention (blocks "81" indicating measured points). At the left hand side of the graphs, the clear difference in droplet diameter at lower frequencies is illustrated and the advantage of the invention can be appreciated therefrom.

It will be appreciated that the present invention is not limited by the particular materials, constructional details or conditions of use described herein, but that a variety of materials constructions and conditions of use may be used in accordance with the invention.

What is claimed is:

1. A method of generating liquid droplets from an aperture in a membrane, the aperture having a diameter $\phi$ at one face at most as large as its diameter at the other face, the method comprising:

providing a liquid to the one face of the membrane adjacent the aperture, the liquid having a surface tension $\sigma$ and density $\rho$;

applying a pressure bias such that the pressure of the liquid at the one face of the membrane is lower than the pressure immediately adjacent to the opposing face of the membrane; and while the bias pressure is applied, vibrating the membrane at a frequency f which is determined by the relationship:

$$f \leq \left(\frac{8\pi\sigma}{27\rho\phi^3}\right)^{1/2}$$

in order to generate droplets emergent from the other face.

2. A method according to claim 1, wherein the frequency f is determined by the relationship:

$$f \leq \left(\frac{2.13 \times 10^{-5} \cdot \pi}{\phi^3}\right)^{1/2}.$$

3. A method according to claim 1, wherein the liquid is brought to the perforate membrane at a pressure equal to that immediately in front of the perforate membrane.

4. A method according to claim 3, wherein, when atomisation into droplets is required, the pressure of the liquid body that contacts those perforations is reduced to below the pressure immediately in front of the perforate membrane.

5. A method according to claim 3, wherein, when atomisation into droplets is required, the pressure of the atmosphere immediately in front of the membrane is increased.

6. A method according to claim 1, wherein the liquid is brought to the perforate membrane at a higher pressure that is insufficient, of itself, to cause the liquid to flow through the perforations.

7. A droplet generator for generating droplets of a liquid having a surface tension σ and density ρ, the droplet generator comprising:

a membrane having a first face and a second face, an aperture extending through the membrane from the first face to the second face, the aperture being of a diameter ϕ at the first face at most as large as its diameter at the second face;

means for applying a pressure bias such that the pressure of the liquid at the first face of the membrane is lower than the pressure immediately adjacent to the second face of the membrane; and a vibration generating means for causing the membrane to vibrate at a frequency f which is determined by the relationship:

$$f \leq \left(\frac{8\pi\sigma}{27\rho\phi^3}\right)^{1/2}$$

in order to generate droplets emergent from the other face.

8. A droplet generator according to claim 7, wherein the frequency f is determined by the relationship:

$$f \leq \left(\frac{2.13 \times 10^{-5} \cdot \pi}{\phi^3}\right)^{1/2}.$$

9. A droplet generator according to claim 7, wherein the atomisation head includes an aerosol generation device.

10. A droplet generator according to claim 7, wherein the atomisation head includes an ink jet device.

11. A droplet generator according to claim 7, wherein the vibration generating means is integrally or intimately formed with the membrane.

12. A liquid atomisation head for a droplet generator for generating droplets of a liquid having a surface tension a and density p, the liquid atomisation head comprising:

a membrane having a first face and a second face, an aperture extending through the membrane from the first face to the second face, the aperture being of a diameter ϕ at the first face at most as large as its diameter at the second face; and a vibration generating means for causing the membrane to vibrate at a frequency f which is determined by the relationship:

$$f \leq \left(\frac{8\pi\sigma}{27\rho\phi^3}\right)^{1/2}$$

in order to generate droplets emergent from the other face.

13. A liquid atomisation head according to claim 12, wherein the frequency f is determined by the relationship:

$$f \leq \left(\frac{2.13 \times 10^{-5} \cdot \pi}{\phi^3}\right)^{1/2}.$$

* * * * *